US006029490A

United States Patent [19]

Minnerop et al.

[11] Patent Number: 6,029,490

[45] Date of Patent: Feb. 29, 2000

[54] DEVICE FOR CHANGING THE VERTICAL POSITION OF THE VERTICAL ROLLS IN UNIVERSAL ROLL STANDS

[75] Inventors: Michael Minnerop, Ratingen; Hans-Jürgen Reismann, Düsseldorf; Hubert Müller, Grevenbroich, all of Germany

[73] Assignee: SMS Schloemann-Siemag Aktiengesellschaft, Düsseldorf, Germany

[21] Appl. No.: 08/786,317

[22] Filed: Jan. 22, 1997

[30] Foreign Application Priority Data

Jan. 23, 1996 [DE] Germany ..... 296 01 082

[51] Int. Cl.[7] ..... B21B 13/10

[52] U.S. Cl. ..... 72/225; 72/240

[58] Field of Search ..... 72/224, 225, 226, 72/237, 240, 248

[56] References Cited

U.S. PATENT DOCUMENTS

| | | | |
|---|---|---|---|
| 3,217,526 | 11/1965 | Wilson et al. | 72/239 |
| 3,948,072 | 4/1976 | Aramaki | 72/248 |
| 4,706,484 | 11/1987 | Dittmar et al. | 72/225 |
| 5,327,761 | 7/1994 | Piasecki et al. | 72/225 |

FOREIGN PATENT DOCUMENTS

| | | |
|---|---|---|
| 591883 | 1/1934 | Germany . |
| 677324 | 6/1939 | Germany . |

OTHER PUBLICATIONS

Patent Abstracts of Japan, vol. 009, No. 029 (M–356), Feb. 7, 1985 & JP 59 174205 A (Hitachi Zosen KK), Oct. 2, 1984.

Patent Abstracts of Japan, vol. 009, No. 057 (M–363), Mar. 13, 1985 & JP 59 173701 A (Kawasaki Seitetsu KK), May 14, 1986.

*Primary Examiner*—Rodney Butler
*Attorney, Agent, or Firm*—Friedrich Kueffner

[57] ABSTRACT

A device for changing the vertical position of the vertical rolls in universal roll stands for rolling girders of different heights, wherein the vertical cross section of the housing of the bearing chock is constructed asymmetrically and the vertical distances of the planes of the two slideways of the bearing chock from the horizontal longitudinal center plane of the vertical roll are dimensioned differently. The increase of the distance between the roller table and the center of the vertical roll can also be achieved by shims which can be placed and fastened on horizontal guide surfaces of the bearing chocks of the vertical rolls of the universal roll stand.

1 Claim, 1 Drawing Sheet

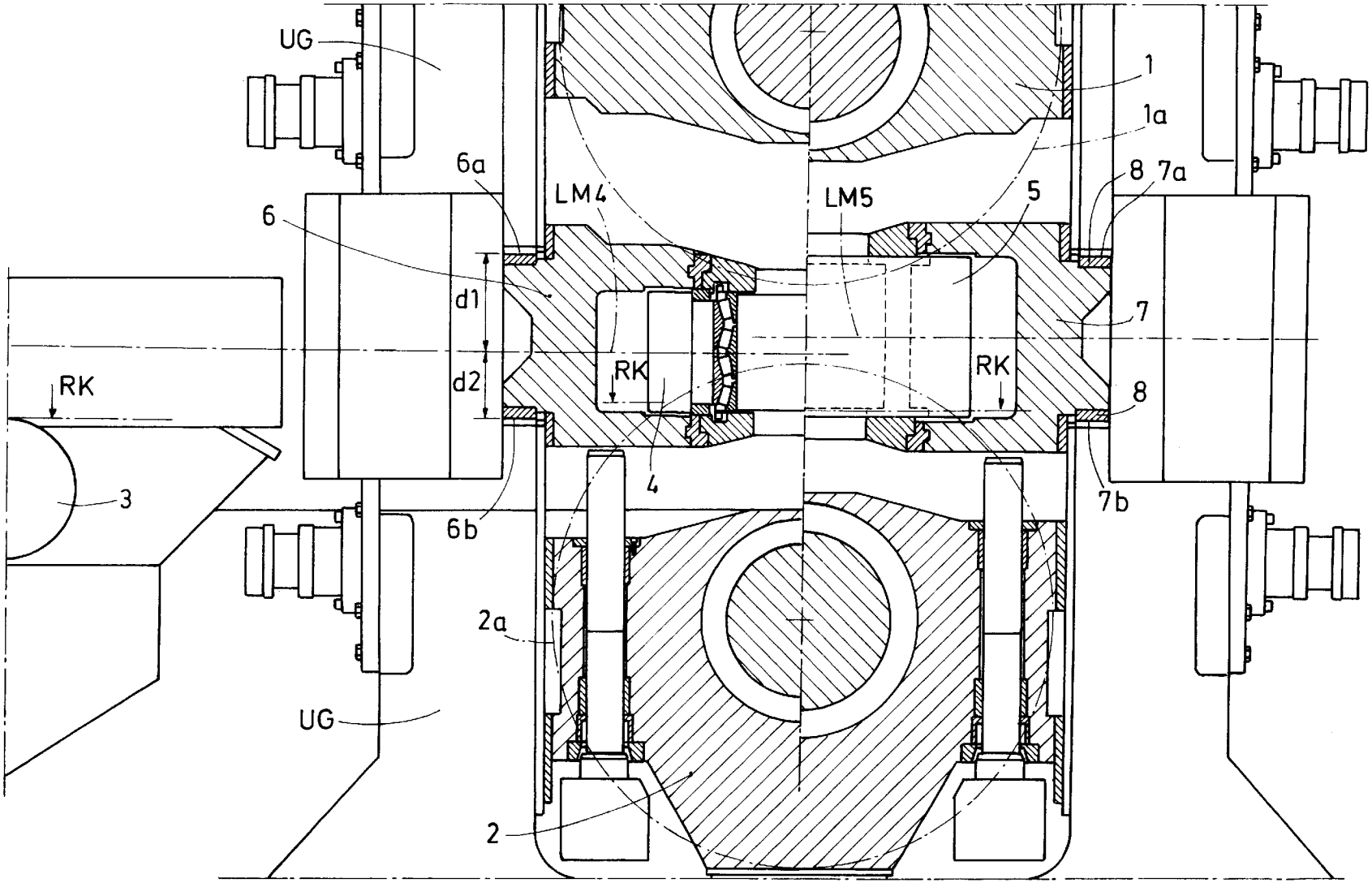
1
1a
8
7a
7
8
7b
5
RK
LM5
4
RK
LM4
6a
d1
d2
6b
2a
2
UG
6
UG
RK
3

DEVICE FOR CHANGING THE VERTICAL POSITION OF THE VERTICAL ROLLS IN UNIVERSAL ROLL STANDS

BACKGROUND OF THE INVENTION

1. Field of the Invention

The present invention relates to a device for changing the vertical position of the vertical rolls in universal roll stands for rolling girders of different heights.

2. Description of the Related Art

When rolling girders, particularly H-girders in universal roll stands, it is necessary, in order to adapt to the respective girder height, to displace the height of the center of the stand relative to the upper edge of the roller table which transports the girder to and from the roll stand (half girder height+air gap). This displacement was effected in the past by means of complicated wedge-type adjustment means which are relatively labor-intensive.

SUMMARY OF THE INVENTION

Therefore, it is the primary object of the present invention to reduce the technical requirements and to avoid any additional labor requirements from the outset.

In accordance with the present invention, the vertical cross section of the housing of the bearing chock is constructed asymmetrically and the vertical distances of the planes of the two of guide surfaces provided in the housing for the bearing chock from the horizontal longitudinal center plane of the vertical roll are dimensioned differently.

In other words, in accordance with the present invention, a bearing chock having an asymmetrical cross-section is used. However, in that case, for each of the different girder heights to be rolled, it is necessary to mount and remove appropriate bearing chocks.

In accordance with another embodiment of the present invention, the increase of the distance between the roller table and the center of the vertical roll can also be achieved by shims which can be placed and fastened on the horizontal guide surfaces of the bearing chocks of the vertical rolls of the universal roll stand.

As a result of this configuration, the bearing chocks and, together with the bearing chocks, the vertical rolls are moved in a sliding manner on the shims at an increased distance above the upper edge of the roller table determined by the thickness of the shims. It is not necessary to adjust the entire stand.

In order to maintain the frictional engagement in the vertical portion of the universal stand at a common level, another feature of the present invention provides that the crossbeams which receive the rolling pressure from the vertical rolls are arranged so as to be vertically adjustable in the universal roll stand.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a partial sectional view of a universal roll stand.

DESCRIPTION OF THE PREFERRED EMBODIMENTS

In the partial sectional view of the drawing, a universal roll stand is shown from the side and transversely of the rolling direction. As can be seen in the drawing, the bearing chocks 1 and 2 of the upper and lower horizontal rolls 1*a*, 2*a* are vertically guided in the frame UG of the universal roll stand. The supports, not shown, are guided above the roller table 3 in the roll stand between the two horizontal rolls and the force from the vertical rolls acts from the side on the supports.

In the illustrated embodiment, the vertical rolls to the left of the vertical center line of the drawing are denoted by reference numeral 4 and the vertical rolls to the right of the center line are denoted by reference numeral 5. The vertical roll 4 is supported in a bearing chock 6 and the vertical roll denoted by reference numeral 5 is supported in a bearing chock 7.

The vertical distance of the longitudinal center LM5 of the vertical roll on the right as shown in the drawing from the upper edge RK of the roller table is determined by the shims 8 on the guide surfaces 7*a* and 7*b*; the distance can be changed by replacing the shims 8 by shims having different thicknesses or by adding additional shims.

The vertical distances d1 and d2 of the horizontal longitudinal center plane LM4 of the vertical roll 4 from the planes of the guide surfaces 6*a* and 6*b* are dimensioned differently and result in an asymmetric configuration of the vertical cross-section of the housing of the bearing chock 6 while reducing the distance of longitudinal center LM4 from the upper edge RK of the roller table.

While specific embodiments of the invention have been shown and described in detail to illustrate the inventive principles, it will be understood that the invention may be embodied otherwise without departing from such principles.

We claim:

1. A universal roll stand for selectively rolling girders having different girder heights, the universal roll stand comprising exchangeable bearing chocks and vertical rolls mounted in the bearing chocks, each vertical roll having a horizontal longitudinal center plane, the universal roll stand having stationary guide surfaces for each bearing chock, wherein the bearing chocks together with the vertical rolls are slidable into and out of the universal roll stand on the guide surfaces, the guide surfaces extending in planes, wherein vertical distances of the planes of the guide surfaces from the horizontal longitudinal center plane of each vertical roll are dimensioned differently in dependence on the girder height of the girder being rolled.

* * * * *